US005086563A

United States Patent [19]

Sakuma et al.

[11] Patent Number: 5,086,563

[45] Date of Patent: Feb. 11, 1992

[54] SCISSORS WITH REPLACEABLE CUTTING BLADES

[75] Inventors: Shuji Sakuma, Tokyo; Seigo Kanematsu, Seki; Yasuo Hiramatsu, Tokyo, all of Japan

[73] Assignees: Kabushiki Kaisha Sangi, Tokyo; Kanematsu Koguo Kabushiki Kaisha, Gifu; Yugen Kaisha Works, Tokyo, all of Japan

[21] Appl. No.: 668,056

[22] Filed: Mar. 12, 1991

[30] Foreign Application Priority Data

May 29, 1990 [JP] Japan ..... 2-56379[U]

[51] Int. Cl.[5] ..... B26B 13/00

[52] U.S. Cl. ..... 30/260; 30/254; 30/341

[58] Field of Search ..... 30/254, 194, 258, 260, 30/341, 349

[56] References Cited

U.S. PATENT DOCUMENTS

| | | | |
|---|---|---|---|
| 106,649 | 8/1870 | Bainard | 30/341 |
| 1,208,202 | 12/1916 | Piggott | 30/349 |
| 1,942,324 | 1/1934 | Byangs, Jr. | 30/341 |
| 1,956,588 | 5/1934 | Parker et al. | 30/260 |
| 2,016,107 | 10/1935 | Forsberg | 30/260 |
| 2,195,353 | 3/1940 | Atchison | 30/260 |
| 2,294,832 | 9/1942 | Colla, Jr. | 30/260 |
| 4,612,708 | 9/1986 | Hattori | 30/260 |
| 4,914,820 | 4/1990 | Saito | 30/254 |

FOREIGN PATENT DOCUMENTS

| | | | |
|---|---|---|---|
| 2133730 | 8/1984 | United Kingdom | 30/254 |

*Primary Examiner*—Mark Rosenbaum
*Assistant Examiner*—Hwei-Siu Payer
*Attorney, Agent, or Firm*—Finnegan, Henderson, Farabow, Garrett & Dunner

[57] ABSTRACT

Scissors with replaceable cutting blades include a pair of handles to which cutting blades are detachable, the handles being pivotally connected to each other by a screw. Each handle has a longitudinally extending groove in which a shank of the corresponding cutting blade is inserted, and a retaining plate is disposed so as to cross a portion of the groove. The shank of the cutting blade inserted into the groove is supported on the handle by the retaining plate so that screws are not needed to attach the cutting blade to the handle.

1 Claim, 4 Drawing Sheets

SCISSORS WITH REPLACEABLE CUTTING BLADES

BACKGROUND OF THE INVENTION

1. Field of the Invention

This invention relates to scissors with replaceable cutting blades particularly suited to individuals such as barbers who make frequent use of scissors.

2. Description of the Prior Art

As shown in FIGS. 6, 7 and 8, conventional scissors with replaceable cutting blades include a movable blade 3 and a fixed blade 4, each of which comprises a cutting edge 1 and a handle 2. The movable blade 3 and the fixed blade 4 are pivotally joined by a screw 5. When it is desired to increase the resistance of the moving blade 3 to the fixed blade 4 so that such resistance will conform to the hardness of hair or to the gripping force of the individual barber, the tightness of the screw 5 is suitably adjusted.

The cutting edge 1 of scissors of this type has a shank 6 at its base end, and the handle 2 has a groove 7 which receives the shank 6. The shank 6 has a pair of threaded screw holes 8*a*, 8*b*, and an unthreaded screw hole 9 located between the two holes 8*a*, 8*b*. The groove 7 has through-holes 10*a*, 10*b* and 11 which register respectively with the screw holes 8*a*, 8*b* and 9 when the shank 6 is fitted into the groove 7. The holes 10*a*, 10*b*, 11 are sized to agree with the holes 8*a*, 8*b*, 9, respectively. Accordingly, by screwing screws 12*a*, 12*b* into the threaded screw holes 8*a*, 8*b* via the through-holes 10*a*, 10*b* from the side opposite the groove 7 of handle 2, the cutting edge 1 and the handle 2 are fixed together and the movable blade 3 and fixed blade 4 are formed. As shown in FIG. 6, the two blades 3 and 4 are joined by passing the screw 5 through the aligned through-holes 9, 11 and tightening the screw by a nut.

When the cutting blade 1 needs to be replaced owing to dulling or nicking of the edge with long use, the screw 5 is withdrawn, the movable blade 3 and fixed blade 4 are separated from each other and then the screws 12*a*, 12*b* are withdrawn to separate the cutting blade 1 from the handle 2. A new cutting blade 1 is attached to the handle 2 and the movable and fixed blades 3, 4 are rejoined by the screw 5 by reversing the above-described procedure.

Barbers find such replacement solely of the cutting blade 1 highly useful since professional people who can grind and sharpen are presently in short supply.

As will be understood from FIGS. 6, 7 and 8, the example of the prior art is such that the small screws 12*a*, 12*b* are screwed into the screw holes 8*a*, 8*b* to secure the cutting blade 1 to the handle 2. However, in scissors of this type, the movable blade 3 is moving repeatedly a more large number of times relative to the fixed blade 4, and the resistance met by the cutting blade constantly changes. Owing to these harsh operating conditions, the screws 12*a*, 12*b* loosen and the cutting blade 1 develops play. Consequently, it is necessary to retighten the screws 12*a*, 12*b* with a screwdriver. However, since the screw holes 8*a*, 8*b* are short in length and the screw threads are small, repeated retightening of the screws 12*a*, 12*b* causes the screw holes 8*a*, 8*b* to be enlarged, thereby necessitating that the cutting blade 1 be replaced regardless of the fact that the cutting blade may still be sharp. This is not economical.

Other drawbacks are that replacement cannot be performed in a simple manner, and that a user who is not a scissors specialist cannot perform the replacement simply or accurately.

SUMMARY OF THE INVENTION

Accordingly, an object of the present invention is to provide scissors of the type having replaceable cutting blades, in which the foregoing problems encountered in the prior art are solved.

According to the present invention, the foregoing object is attained by providing scissors in which the cutting blade is attached to the corresponding handle by a means which does not rely only upon a screw.

More specifically, the foregoing object is attained by providing scissors comprising a pair of cutting blades each having a longitudinally extending shank at the base end thereof, a pair of handles each having a longitudinally extending groove in the base end thereof, the groove receiving the shank of a respective end of the pair of cutting blades, a pair of retaining plates each crossing a portion of the groove of the respective groove of the pair of handles for supporting on the one handle the respective shank received within the groove, and a screw for pivotally connecting the pair of handles to which the pair of cutting blades have been attached by inserting the shanks into the respective grooves.

When the shank of one of the cutting blades is inserted into the groove of the corresponding handle, the shank is fitted between the corresponding retaining plate and the bottom of the groove. As a result, the shank is held snugly at the bottom of the groove by the retaining plate and the shank will not slip out of the groove in a direction perpendicular to the groove bottom. In addition, the side walls of the groove prevent the shank from slipping out in a direction transverse to the longitudinal direction of the groove.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
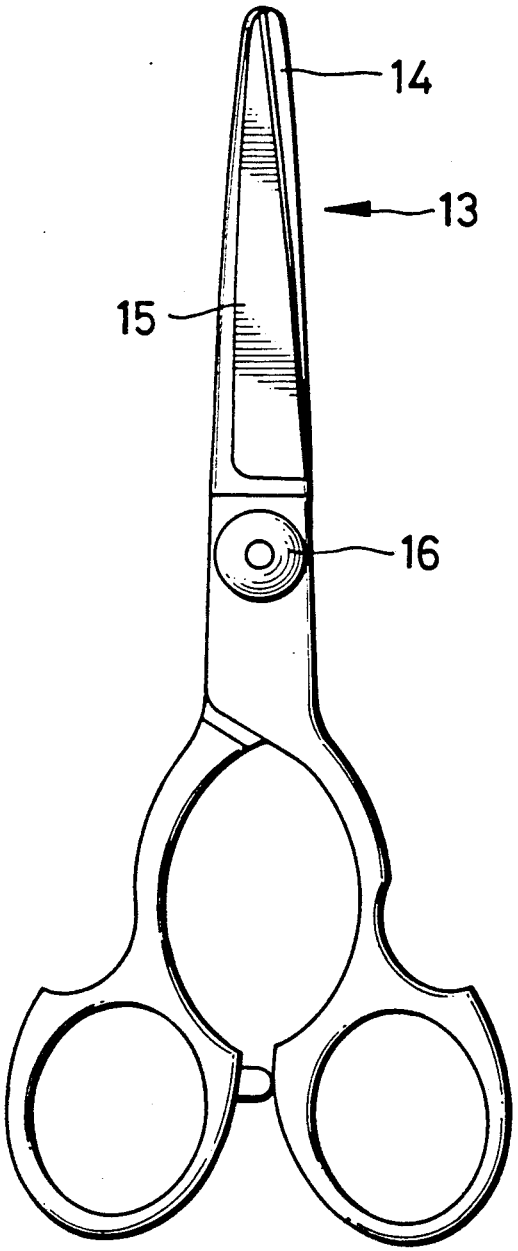
FIG. 1 is a plan view illustrating an embodiment of scissors according to the present invention.
Figure 2:
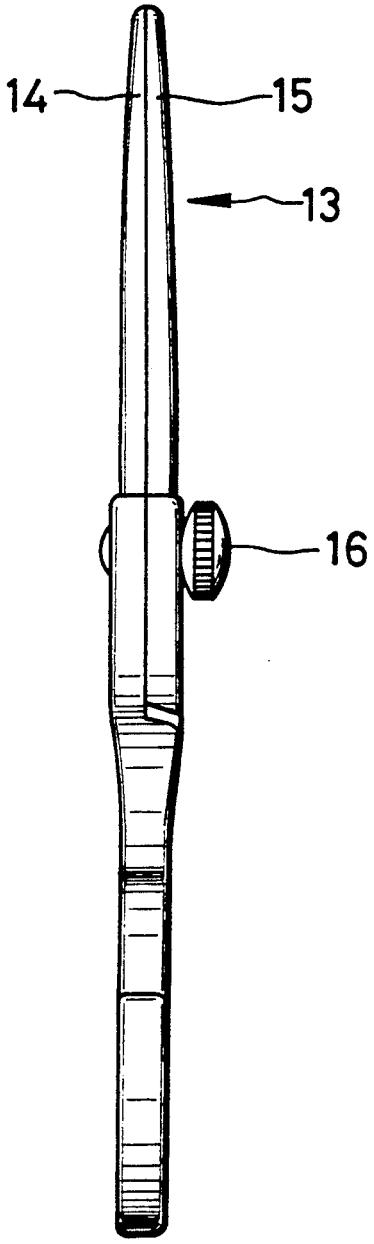
FIG. 2 is a side view of the scissors shown in FIG. 2.
Figure 3:
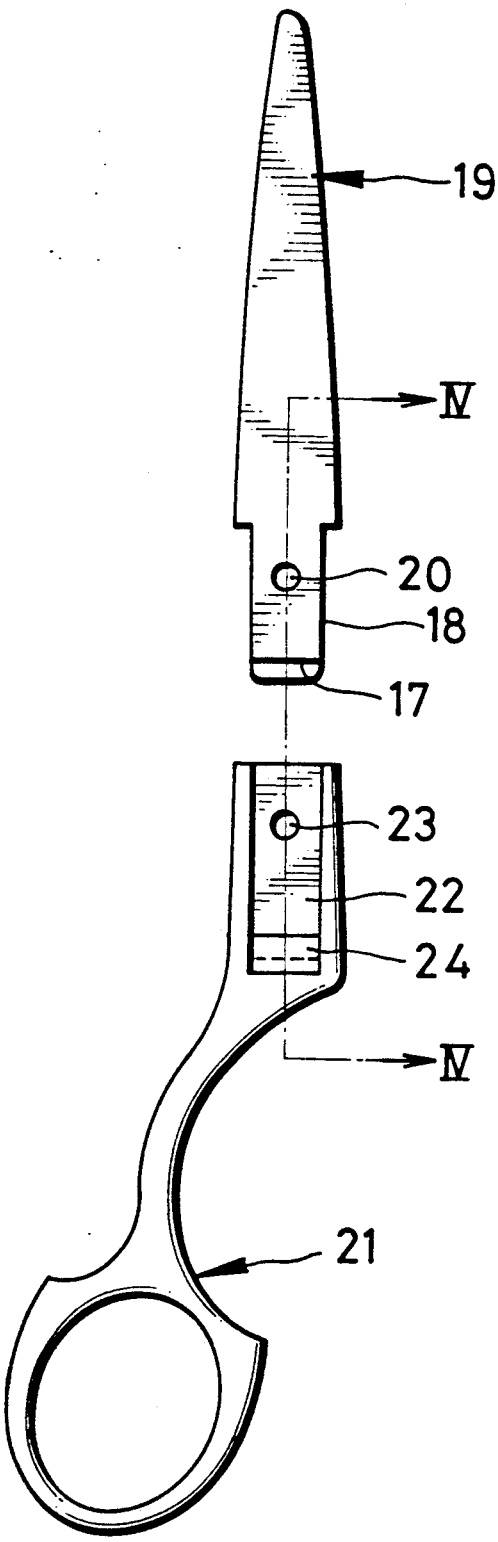
FIG. 3 is a plan view of the cutting edge portion and the handle portion of a blade of the scissors separated from one another.
Figure 4:
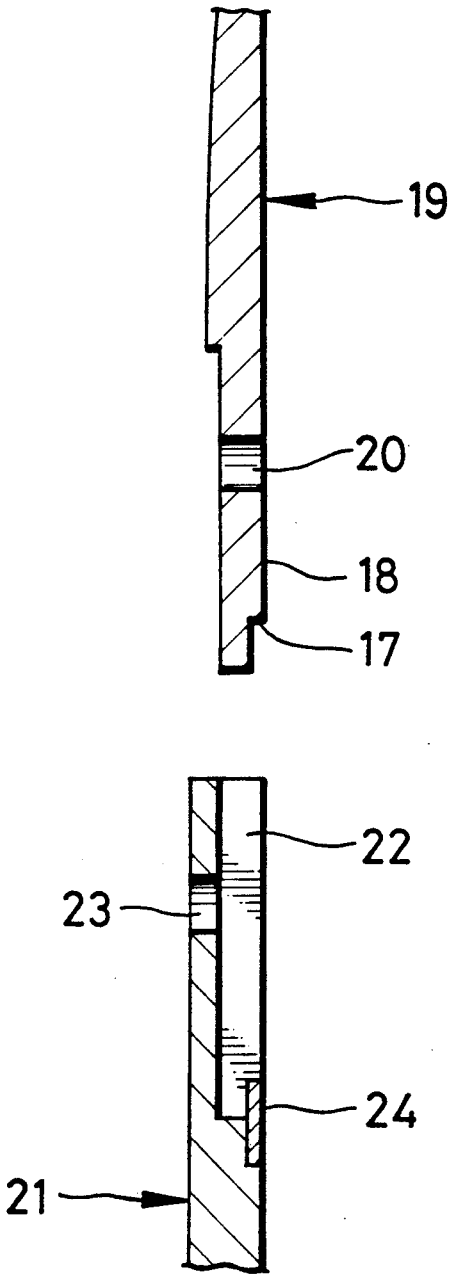
FIG. 4 is a sectional view taken along line IV—IV of FIG. 3.
Figure 6:
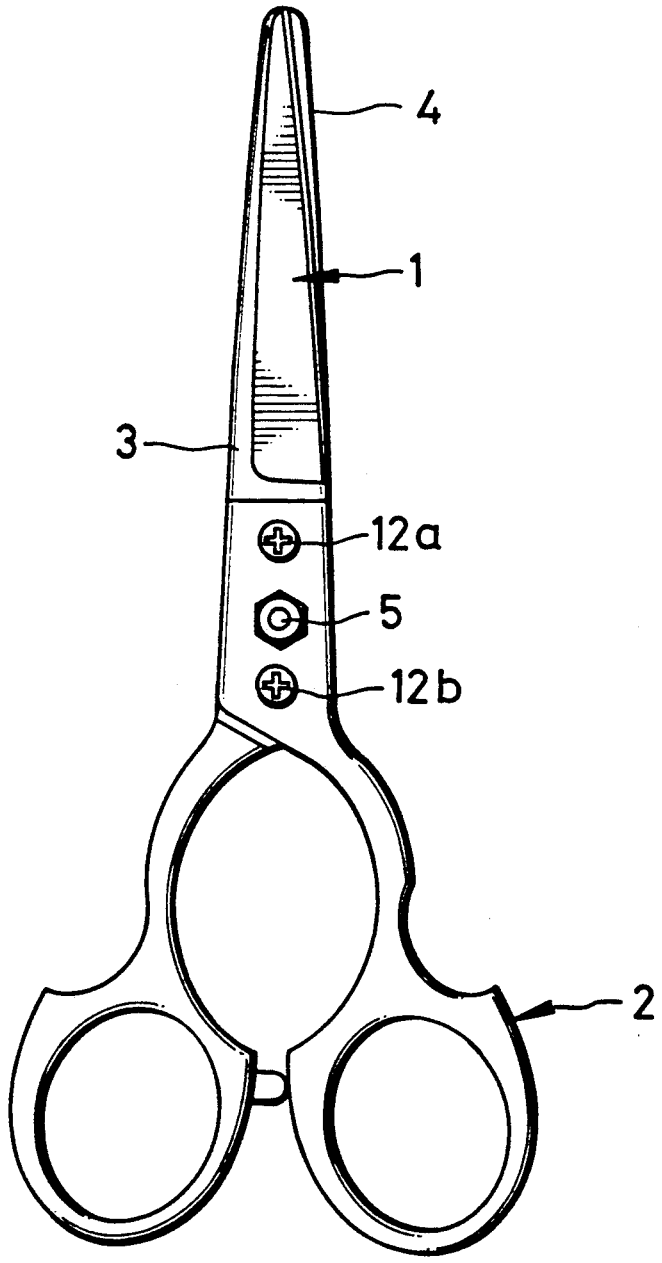
FIG. 6 (PRIOR ART)
FIG. 6 is a plan view of scissors according to the prior art.

A preferred embodiment of scissors with a replaceable cutting blade will now be described with reference to FIGS. 1 through 5.

According to the present invention, scissors 13 with replaceable cutting blades includes a fixed blade 14 and a movable blade 15 joined by a screw means such as a screw 16 and cooperating unit. Each blade includes a cutting edge portion 19 having a shank 18 at its base end. The shank 18 has a step portion 17 and a centrally located through-hole 20 through which the screw 16 can pass.

Each blade also has a handle portion 21 having a groove 22 for receiving the shank 18, and a through-hole 23 which, when the shank 18 is fitted into the groove 22, registers with the through-hole 20 of cutting edge portion 19. A retaining plate 24 is soldered to the handle 21 so as to extend across and cover a portion of the groove 22. In the illustrated embodiment, the retaining plate 24 is substantially flush with one surface of the handle 21, with half the plate being in contact with the handle 21 and the remaining half overlapping the groove 22. However, the shape of the retaining plate 24 is not limited to that of the illustrated embodiment. For example, an arrangement can be adopted in which the retaining plate 24 is provided at its center with a small hole, the handle 21 is provided with a protruding pin, and the pin is press-fitted into the small hole. Alternatively, an arrangement can be adopted in which a longitudinal side wall of the groove 22 is formed to have a portion projection toward the opposing side wall, and this projecting portion is made to serve as the retaining plate.

Figure 5:
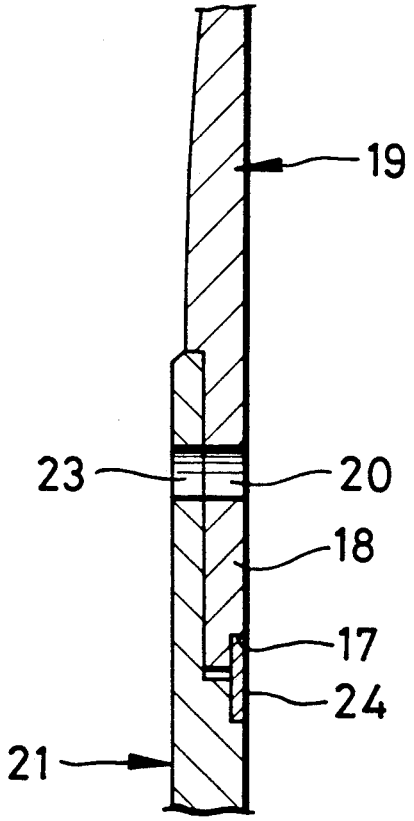
FIG. 5 is a sectional view showing the connection between the cutting edge portion and handle portion.
Figure 7:
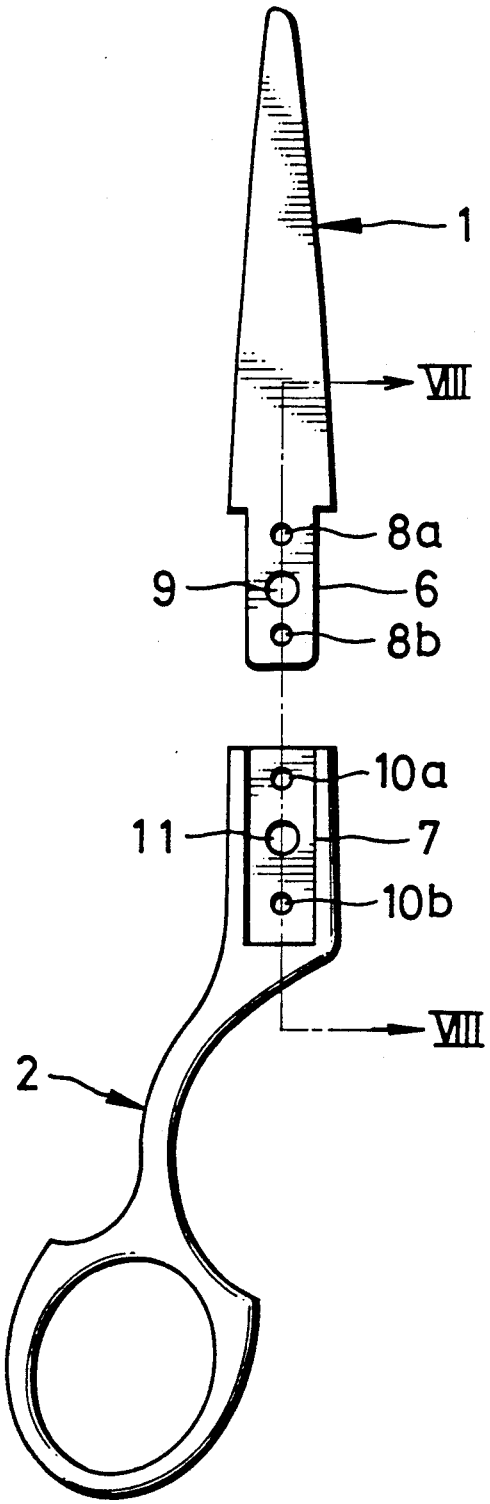
FIG. 7 (PRIOR ART)
FIG. 7 is a plan view of the cutting edge portion and handle portion of a blade of the scissors shown in FIG. 6.
Figure 8:
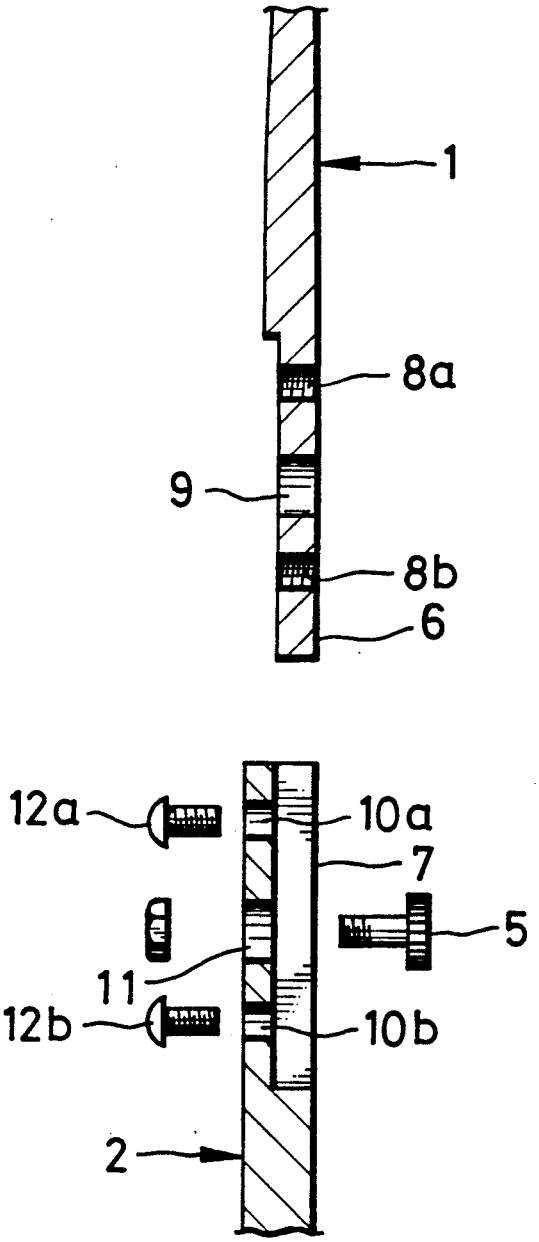
FIG. 8 (PRIOR ART)
FIG. 8 is a sectional view taken along line VIII—VIII of FIG. 7.

The shank 18 of the cutting edge 19 is fitted into the groove 22 of handle 21 and, as shown in FIG. 5, the step portion 17 of shank 18 is held in the bottom of the groove 22 by the retaining plate 24. Thus, the cutting edge 19 and the handle 21 are held in supporting relation by the plate 24, and the through-holes 20, 23 are in perfect registration. The two blades 14, 15, each having its own cutting edge 19 and handle 21 held together by the retaining plate 24, are pivotally fastened together by passing the screw 16 through the registered holes 20, 23 therein and tightening the screw with a nut. The magnitude of the tightening force of screw 16 corresponds to the strength of the force holding the movable blade 15 on the fixed blade 14.

To replace cutting edge 19, the screw 16 is loosened, the two blades 14, 15 are separated from each other, the cutting edge 19 is withdrawn from the handle 21, the old cutting edge is replaced by a new one, and then this procedure is reversed to reassemble the scissors with the new cutting edge substituted for the old.

Thus, in accordance with the present invention, the cutting edge 19 is secured to the handle 21 without using extra screws. This solves one of the problems of the prior art, namely the enlargement of the screw holes and the attendant loosing any of the screws, which with repetition could make it impossible to use the scissors.

Furthermore, the manner of replacing the cutting edge 19 no longer requires that it be fastened to the handle 21 by very small screws, as is necessary in the prior art. The operators skill therefore is simplified and a screwdriver for small screws is no longer needed. In other words, the present invention eliminates the looseness of screws problem, simplifies the replacement of the cutting edges and dispenses with the need to use special tools for replacing them.

As many apparently widely different embodiments of the present invention can be made without departing from the spirit and scope thereof, it is to be understood that the invention is not limited to the specific embodiments thereof except as defined in the appended claims.

What is claimed is:

1. Scissors comprising a pair of blades adapted to pivotally cooperate with each other, each blade comprising a cutting portion having a cutting edge at one end and a longitudinally extending shank at a base end thereof with a through hole in said shank, a handle portion having a longitudinally extending groove in one end thereof for receiving in a recessed manner the shank of the cutting portion, said handle having a through hole therein that aligns with the through hole in the shank of the cutting portion when the shank is inserted into said groove and a retaining plate covering a portion of the groove therein for holding said shank of said cutting portion in said groove, said retaining plate being located across a bottom end of said groove, said shank of said cutting portion having a step on its base end that engages under said retaining plate, the exposed surface of said shank being flush with the surface of said handle portion adjacent said groove, and screw means adapted to pass through said pairs of aligned holes to pivotally connect said pair of blades together.

* * * * *